US005159146A

United States Patent [19]

Carisella et al.

[11] Patent Number: 5,159,146

[45] Date of Patent: Oct. 27, 1992

[54] METHODS AND APPARATUS FOR SELECTIVELY ARMING WELL BORE EXPLOSIVE TOOLS

[75] Inventors: James V. Carisella, 7524 Garnet, New Orleans, La. 70124; Robert B. Cook, Mandeville, La.

[73] Assignee: James V. Carisella, New Orleans, La.

[21] Appl. No.: 754,538

[22] Filed: Sep. 4, 1991

[51] Int. Cl.[5] ..... F42C 15/00; E21B 43/116

[52] U.S. Cl. ..... 89/1.15; 102/222; 175/4.54

[58] Field of Search ..... 175/4.54, 4.56; 166/55.1; 337/401, 416; 89/1.15; 102/222

[56] References Cited

U.S. PATENT DOCUMENTS

| | | | |
|---|---|---|---|
| 2,084,218 | 6/1937 | Rémondy | 102/222 |
| 2,314,891 | 3/1943 | Moore | 102/222 |
| 2,363,234 | 11/1944 | Doll | 175/4.55 |
| 3,002,456 | 10/1961 | Savitt | 102/222 |
| 3,774.541 | 11/1973 | Bratton | 102/275.1 |
| 4,011,815 | 3/1977 | Garcia | 89/1.15 |
| 4,025,889 | 5/1977 | Schwarz | 337/408 |
| 4,314,614 | 2/1982 | McPhee et al. | 175/4.56 |
| 4,523,650 | 6/1985 | Sehnert et al. | 175/4.56 |
| 4,852,454 | 8/1989 | Batchelder | 89/1.11 |
| 5,070,788 | 12/1991 | Carisella et al. | 102/222 |

*Primary Examiner*—David H. Brown

*Attorney, Agent, or Firm*—E. R. Archambeau, Jr.

[57] ABSTRACT

In the representative embodiments of the several methods and apparatus of the invention, a barrier formed of a low-temperature fusible metal alloy having a selected melting point greater than the anticipated well bore temperatures is arranged between a receptor explosive and a typical electrically-initiated detonator enclosed in a housing for blocking the transmission of detonation forces from the detonator to the receptor explosive until the barrier has been heated by an electrical heater adjacent to the barrier. By selecting a fusible metal alloy which has a melting point higher than the known temperatures of the well bore fluids, when the tool is exposed to those elevated temperatures, the barrier will be predictably maintained in its solid state to continue blocking the detonation path of the donor explosive if the heater fails thereby allowing the well tool carrying the explosives to be safely recovered from the well bore.

22 Claims, 2 Drawing Sheets

METHODS AND APPARATUS FOR SELECTIVELY ARMING WELL BORE EXPLOSIVE TOOLS

BACKGROUND OF THE INVENTION

Electrically-initiated or so-called "electric" detonators are commonly employed for actuating one or more explosive devices on various types of well bore tools such as perforating guns, explosive cutting tools, chemical tubing cutters and explosive backoff tools. These tools are typically dependently supported in a well bore by a so-called "wireline" or suspension cable with electrical conductors connected to a surface power source. The detonators that are typically used with these wireline tools with explosive devices are usually comprised of a fluid-tight hollow shell encapsulating an igniter charge (such as black powder or an ignition bead) that is disposed around an electrical bridge wire positioned adjacent to a primer explosive charge such as lead azide that is set off when electric current is passed through the bridge wire. Some detonators may also include a booster charge of a more-powerful, less-sensitive secondary explosive (such as RDX or PETN) which is cooperatively arranged in the shell to be detonated by the less-powerful primer explosive charge. These detonators are typically coupled to an explosive detonating cord positioned in detonating proximity of the one or more explosive charges carried by the wireline tool.

It is, of course, imperative that none of these explosive devices are inadvertently actuated while the well bore tool is at the surface to prevent fatalities and injuries to personnel as well as avoid damaging nearby equipment. One common cause of the inadvertent actuation of wireline well tools employing electric detonators is the careless application of power to the conductors in the cable after the detonator has been electrically connected to the conductors. To minimize that risk, key-operated switches are frequently used for disabling the surface power source until the well tool has been lowered to a safe depth in the well bore. Another common safety technique is to enclose the detonator in a so-called "safety tube" until the detonator is installed in the tool. It must also be realized that should the wireline tool be returned to the surface without its explosive charges having been fired, this significant hazard to nearby personnel and equipment will again reappear while the detonator is being removed from the tool body, disconnected from the detonating cord and the cable conductors, and returned to a safety tube or some other suitable explosion-resistant container.

These safety procedures will, of course, greatly reduce the chances that some human error will be responsible for inadvertent actuation of one of these well tools with explosive devices while it is located at the surface. Nevertheless, a major source of the inadvertent actuation of these typical wireline tools is that the electric detonators commonly used in these tools are quite susceptible to strong electromagnetic fields. Another source of inadvertent actuation of these detonators is the unpredictable presence of so-called "stray voltages" which may sporadically appear in the structural members of the drilling platform. Such stray voltages are not ordinarily present; but these voltages are often created by power generators being used on the drilling rig as well as the cathodic protection systems used to counter galvanic corrosion cells that may be present at various locations in the structure. Lightning may also set off these detonators. At times, hazardous voltage differences may also be developed between the wellhead, the structure of the drilling rig and the electrical equipment used to operate the well tools. A recent SPE technical paper which was authored by K. B. Huber and titled "Safe Perforating Unaffected by Radio and Electric Power" (SPE 20635 presented Sep. 22–26, 1990) gives an analysis of the hazards and the current state of the prior art for safeguarding wireline tools with explosive devices such as various types of perforators.

Because of these potential hazards that exist once a typical wireline explosive tool has been armed, many proposals have been made heretofore for appropriate safeguards and precautions to be taken while these tools are at the surface. For instance, when a perforating gun is being prepared for lowering into a wellbore, in keeping with the susceptibility of typical electric detonators to strong electromagnetic fields it is prudent to maintain strict radio silence in the vicinity. Ordinarily temporary restrictions on nearby radio transmissions will not represent a significant problem on a land rig. On the other hand, when a wireline tool with explosives is being used on a drilling vessel or an offshore platform, it is a common practice to at least restrict, if not totally prohibit, radio and radar transmissions from the platform and any surface vessels and helicopters in the vicinity of the operation. It may be necessary to postpone welding operations on the rig or platform also since welding machines develop currents in the structure that may initiate a sensitive electric detonator in an unprotected explosive tool that is located at the surface.

It will, of course, be recognized that an inordinate amount of time is lost when a wireline explosive tool with an electrical detonator is being prepared for operation on an offshore platform is being prepared since operations unrelated to the particular operation must be curtailed. For example, movements of personnel and equipment by helicopters and surface vessels must be limited to avoid radio and radar transmissions which might set off the detonator. Thus, when an operation with a wireline tool carrying explosives is being considered, the relative priorities of the various operations must be taken into account to decide which of these activities must be curtailed or even suspended in favor of higher-priority tasks. These problems relating to one offshore rig may similarly affect operations on nearby rigs. Accordingly, where there are a large number of these hazardous operations in a limited geographical area, it will be necessary to coordinate the various operations in that field to at least minimize the obvious restrictive effects on those operations.

In view of these problems, various proposals have been made heretofore to disarm these electrical detonators by temporarily interrupting the explosive train between the detonator and the other explosives in the tool. It is, of course, well known that a barrier formed of a dense substance, such as a rubber or metal plug, positioned between the donor and receptor charges in a typical detonator will attenuate the detonation forces of the donor explosive sufficiently to reliably block the detonation of the receptor charge. For example, some commercial detonators are sold with rubber plugs disposed in the fluid-disabling ports that communicate to the empty space between the adjacent charges. This same principle is, of course, employed with the barriers that are disclosed in U.S. Pat. No. 4,314,614 as well as in FIG. 7 of U.S. Pat. No. 4,011,815. U.S. Pat. No. 4,523,650 discloses a disarming device employing a rotatable barrier that is initially positioned to interpose a solid detonation-blocking wall between the donor and receptor explosives in the detonator until just before the perforator is ready to be lowered into the well bore. To arm that detonator, the barrier is rotated to align a booster explosive in the barrier with the spatially-arranged donor and receptor explosives. With any of these prior-art safearming devices, it is, of course, essential to either completely remove or else reposition the temporary barrier before the perforator is lowered into a well bore so that it will thereafter be free to operate. Once any of these temporary barriers has been removed from the perforating gun or repositioned, the detonator in the perforator is thereafter subject to being inadvertently detonated by any of the extraneous hazards discussed above.

A new electronic detonating system described in the above-identified SPE paper includes an electrically-actuated initiator assembly which includes an encapsulated pellet of a secondary explosive that is disposed around a foil-covered metallic bridge. The initiator assembly is spatially disposed from a secondary explosive booster and isolated therefrom by a thin wall or metal partition. The initiator assembly is initially disarmed by means of a removable safety barrier which is temporarily placed in the space between the two charges until the perforator is ready to be lowered into a well bore. The detonating system further includes an electronic cartridge arranged for supplying a sudden burst of electrical energy to the foil-covered bridge to instantaneously vaporize the bridge for forcibly driving a portion of the foil bridge against the secondary explosive pellet with sufficient force to set off the pellet. The detonation of this secondary pellet will, in turn, cause a plug or so-called "flyer" to be sheared out of the end partition of the initiator assembly and forcibly driven across the space between the charges to strike the adjacent end of the secondary explosive booster charge with sufficient force to sequentially induce high-order detonations of the booster charge and a detonating cord that is coupled thereto. It will, of course, be appreciated that since this detonating system does not have any primary explosives, this system is not as suseptible to extraneous electrical energy as are the other prior-art detonating systems described above. Nevertheless, it must be recognized that since an electronic detonating system of this nature is quite expensive, cost considerations may restrict the use of these systems to perforating operations in high-risk locations.

One of the most important advances that has been recently made for selectively and inexpensively safeguarding wireline tools carrying explosive charges has been to form barriers of low-temperature fusible metal alloys and permanently install one of them between the donor and receptor explosives in a detonator for reliably blocking the transmission of detonation forces from the donor explosive until the detonator has been subjected to well bore temperatures greater than the established melting point of the alloy. This unique concept is explained in a co-pending application Ser. No. 550,862 which was filed Jul. 10, 1990, by the Applicants of the present application and is now U.S. Pat. No. 5,070,788. These low-temperature fusible alloy barriers are, however, not feasible in wells where the well bore temperatures are about the same as the lowest attainable melting points of these eutectic and non-eutectic metals.

OBJECTS OF THE INVENTION

Accordingly, it is an object of the invention to provide new and improved methods and apparatus to selectively arm wireline well tools carrying electrical detonators.

It is another object of the present invention to provide a detonating system which is independent of well bore temperatures and safely confines the electrically-initiated detonator in an explosion-resistant housing as well as reliably disarms the detonator until it is selectively armed once a wireline tool carrying explosive devices has been positioned in a well bore.

It is a further object of the present invention to provide new and improved selectively-actuated explosive detonators that are reliably safeguarded from being inadvertently detonated by spurious electrical energy that may be emanated from extraneous stray electrical currents or by nearby radio or radar signals.

It is yet another object of the invention to provide new and improved methods and apparatus for arming explosively-actuated wireline tools only in response to an electrical control signal for a predetermined time period as well as to provide assurance that the tools will be safeguarded should they are subsequently returned to the surface without having been actuated.

SUMMARY OF THE INVENTION

In one manner of carrying out the new and improved methods and apparatus of the present invention, a detonating system is arranged to include an electrically-initiated donor explosive which is confined inside of an explosion-resistant housing and positioned within detonating proximity of an adjacent receptor explosive. An explosion-resistant fusible barrier which has a selected melting point is cooperatively arranged for reliably isolating the donor explosive so long as the fusible barrier is not heated above the melting point of the material forming the barrier. The new and improved detonating system further includes an electrical heater which is selectively operable for removing the barrier only when the detonating system is to be armed.

BRIEF DESCRIPTION OF THE DRAWINGS

The novel features of the present invention are set forth with particularity in the appended claims. The invention along with still other objects and additional advantages thereof may be best understood by way of exemplary methods and apparatus of the invention as best depicted in the accompanying drawings in which:

DESCRIPTION OF A PREFERRED EMBODIMENT OF THE INVENTION

Figure 1:
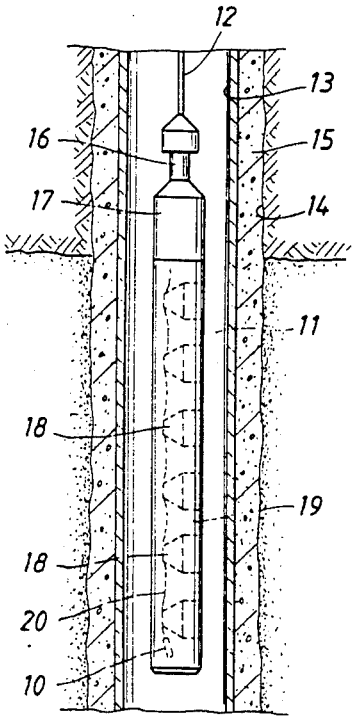
FIG. 1 schematically depicts a wireline perforator having a selectively-armed detonating system cooperatively arranged in accordance with the principles of the invention for reliably disabling and selectively enabling the wireline perforator.

Turning now to FIG. 1, as indicated generally at 10, a new and improved detonating system arranged in accordance with the principles of the invention is shown as this detonating system would be utilized for reliably controlling from the surface the operation of a typical wireline perforator as shown generally at 11. It is to be understood, however, that the new and improved detonating system 10 of the present invention is not necessarily restricted to use with only wireline perforators; but that this unique detonating system can also be employed with other wireline tools with explosive charges which are to be selectively actuated by electric detonators without departing from the intended scope of the invention.

As is typical, the perforator 11 depicted in FIG. 1 is dependently connected to the lower end of a conventional armored suspension cable 12 with one or more electrical conductors which is spooled on a winch (not illustrated in the drawings) at the surface and selectively operated for moving the perforating gun through a casing 13 secured within a borehole 14 by a column of cement 15. The perforating gun 11 is coupled to the lower end of the so-called "wireline cable" 12 by means of a rope socket 16 which facilitates the connection of the electrical conductors of the cable to the new and improved selectively-armed detonating system 10 of the invention. As is typical, the perforating gun 11 preferably includes a collar locator 17 which is connected by way of the conductors in the cable 12 to appropriate surface instrumentation (not illustrated in the drawings) for providing characteristic signals representative of the depth location of the gun as it successively moves past the collars in the casing string 13. As further depicted in FIG. 1, the perforating gun 11 is a typical hollow-carrier perforator cooperatively carrying a plurality of shaped explosive charges 18 mounted at spaced intervals in an elongated fluid-tight tubular body or so-called "carrier" 19. To selectively detonate the charges 18, the lower end of a length of a typical detonating cord 20 of a suitable secondary explosive, such as RDX or PETN, operatively coupled to the downhole portion of the selectively-armed detonating system 10 of the invention; and the cord is extended upwardly through the enclosed carrier 19 and appropriately arranged so as to be positioned in detonating proximity of each of the shaped charges.

Figure 2:
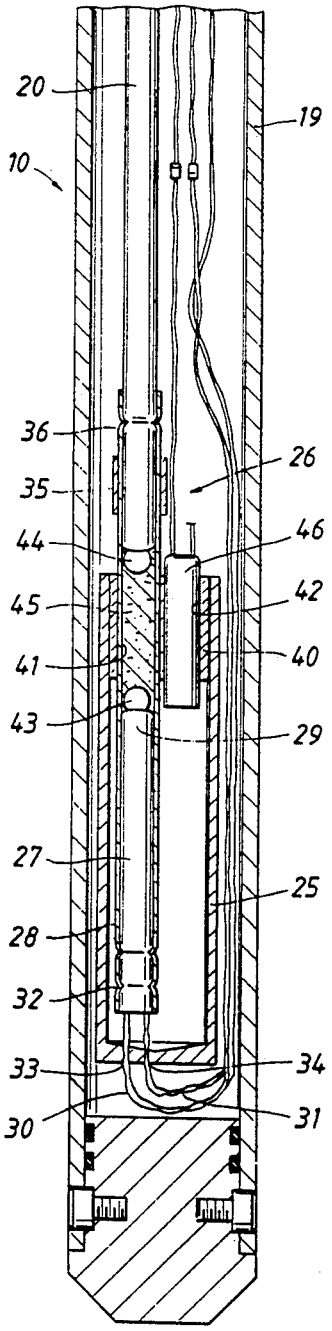
FIG. 2 is an elevational view of a preferred embodiment of the new and improved selectively-armed detonating system of the present invention as it would be typically used in the perforator illustrated in FIG. 1 and depicting the detonating system while it is initially disarmed for preventing the inadvertent firing of the wireline perforator.

Turning now to FIG. 2, the downhole portion of a preferred embodiment of the new and improved detonating system 10 arranged in keeping with the principles of the present invention is shown as being arranged in the lower portion of the enclosed perforator carrier 19. As depicted, the selectively-armed detonating system 10 includes a tubular housing 25 carrying a typical electrically-initiated detonator indicated generally at 26 which is preferably a commercial fluid-disabled detonator (such as those detonators that are currently offered for sale by DuPont as its E-84 or E-85 detonators) which is specially designed for actuating explosive devices in enclosed well tools. Although other types of electric detonators can be alternatively employed without departing beyond the intended scope of the present invention, in the preferred embodiment of the detonating system 10 the electrical detonator 26 includes an encapsulated donor charge 27 which is mounted in the lower end of an elongated thin-walled tube 28 with the closed end 29 of the hollow shell of the encapsulated charge facing upwardly. The donor charge 27 is typically comprised of a primer explosive and a serially-arranged booster explosive (neither of which are illustrated) which are encapsulated within the thin-walled hollow shell. The donor charge 27 further includes an electrical bridge wire (not illustrated) is operatively arranged within the shell of the encapsulated charge for setting off an igniting explosive disposed in the hollow shell within detonating proximity of the primer explosive (neither of which are shown) and connected to electrical leads 30 and 31 extending out of the opposite end of the hollow shell. To protect the explosives, the leads 30 and 31 are typically fluidly sealed within the open end portion of the hollow shell by a rubber plug (not illustrated) secured within the lower end of the elongated thin-walled tube 28 by circumferential crimps 32. Small holes 33 and 34 through the lower end wall of the housing 25 provide passages by which the electrical leads 30 and 31 for the detonator 26 can be extended outside of the housing. As shown in FIG. 2, the detonator leads 30 and 31 are extended upwardly on into the carrier 19 and connected to the firing circuit of the perforator 11 as will subsequently be discussed by reference to FIG. 4. As will be described later, it should be noted that the holes 33 and 34 in the lower end wall of the explosion-resistant housing 25 are made slightly larger than the detonator leads 30 and 31 for providing a pressure-communication path from the interior of the housing to facilitate the escape of explosive gases from the housing should the donor charge 27 be inadvertently set off.

The detonator 26 also includes a receptor or encapsulated booster charge 35 which is arranged in the upper portion of the elongated tube 28 with the closed end 36 of the encapsulated charge being positioned within detonating proximity of the donor charge 27. In the depicted detonator 26, the receptor or booster charge 35 includes a primary explosive disposed within the hollow shell of the encapsulated booster charge adjacent to a secondary explosive (neither of which illustrated). As is typical, the upper end of the elongated tube 28 is cooperatively arranged to receive the lower end of the elongated detonating cord 20 that is secured thereto by a circumferential crimp 36 for dependently supporting the housing 25 and the detonator 26 within the lower portion of the perforator carrier 19.

It will, of course, be appreciated that even though the perforator carrier 19 and the housing 25 provide a measure of shielding for the detonator 26 against the electromagnetic fields from nearby radio or radar transmissions, there is still a risk that the detonator will be inadvertently detonated by spurious electrical energy picked up by the suspension cable 12 (FIG. 1) or from other sources while the perforator 11 is at the surface. Accordingly, in keeping with the objects of the invention, the tubular enclosure 25 is fabricated of a high-strength steel tube of sufficient thickness for reliably and safely withstanding the explosive forces typically produced by the donor charge 27 of the detonator 26 so that the inadvertent detonation of the donor will not present a hazard.

In the illustrated preferred embodiment of the explosion-resistant housing, the housing 25 is cooperatively arranged to be a totally self-contained assembly which completely encloses the electrically-initiated donor charge 27 within the housing so that this self-contained assembly can be transported and handled with a reasonable degree of safety. To enclose the donor charge 27, a cylindrical support member 40 having two closely-spaced parallel elongated bores 41 and 42 is tightly secured within the upper portion of the housing. To mount the detonator 26 in an upright position in the cylindrical support member 40, the eleongated bore 41 is sized for snugly receiving the intermediate portion 38 of the detonator shell 28 that extends between the donor charge 27 and the booster charge 35. Nevertheless this elongated bore 41 is appropriately sized so that when the detonating system 10 is being manually assembled, the detonator shell 28 may be easily inserted into the bore 41 and safely moved further downwardly into the support member 40 until one or more lateral ports 43 in the intermediate portion 38 of the shell are positioned at least slightly below the lower end surface of the support member. It will, of course, be appreciated by those with skill in the art that the fluid-disabled detonators, such as the detonator shown at 26, typically employed in well-perforating operations have upper and lower side openings such as the lateral ports 43 and 44 in the tubular intermediate portion 38 of the detonator shell 28 to be certain that unwanted well bore liquids which may have leaked into the carrier 19 will enter through the ports into the intermediate tubular member to a detonation-blocking position between the donor explosive 27 and the receptor explosive 35.

It will, of course, be realized that since the two charges are within detonating proximity of one another, the donor charge 27 will be capable of setting off the booster charge 35 whenever there is no substantial obstruction blocking the detonation path of the donor charge through the intermediate portion 38 of the elongated tube 28. Thus, in keeping with the objects of the present invention, the new and improved detonating system 10 is cooperatively arranged to prevent inadvertent actuation of the booster charge 35 in the unlikely event that the electrically-initiated donor charge 27 is unwittingly set off in any manner. As a significant aspect of the present invention, therefore, it has been determined that a receptor explosive such as the booster charge 35 can be reliably safeguarded by installing a detonating barrier 45 formed of a fusible material such as a suitable wax or fusible metal alloy in the detonation path of the donor charge 27 for reliably attenuating the explosive forces produced by the detonation of the donor charge. With this unique barrier 45 in position, it has been found that the perforating gun 11 will be reliably and predictably disarmed so long as the fusible material forming the barrier is not subjected to outside temperatures which are greater than the selected melting point of the fusible metal alloy for a sufficient time period to soften or melt the fusible barrier.

Accordingly, with the detonating system 10 illustrated in FIG. 2, the unique disabling function of the barrier 45 is best carried out by arranging the barrier in the form of an elongated plug of a fusible material that preferably fills at least the major portion of the intermediate section 38 of the elongated tube 28 lying between the lateral ports 43 and 44 for reliably blocking the detonation path through the sleeve. Thus, should the electrically-initiated donor charge 27 be inadvertently set off, the barrier 45 will effectively block the transmission of the detonation forces from the donor charge from reaching the booster charge 35. It must, therefore, be emphasized that by virtue of this barrier 45, it is no longer necessary to employ complicated and expensive special-purpose detonators such as those presently under consideration to counter the risk of inadvertent detonations. Thus, in the practice of the present invention, it has been found that standard inexpensive, off-the-shelf commercial detonators such as the detonator 26 can be safely employed in the detonating system 10 without unduly risking the hazards that the detonator might be set off either by spurious electric signals or the inadvertent application of power to the conductors in the suspension cable 12.

In the preferred manner of practicing the invention for safeguarding detonators such as the commercial detonator shown at 26, a cast barrier plug, as at 45, is considered to be the most-effective and inexpensive configuration. In the preferred manner of installing the barrier plug 45 within the intermediate portion 38 of the elongated tube 28, the selected fusible metal alloy is first heated above its melting point in a suitable container. The liquefied alloy is then installed into the intermediate tube portion by means such as a syringe that is inserted into the upper hole 44 in the intermediate tube. The fusible alloy will, of course, rapidly cool to provide the barrier 45. Inasmuch as different alloys of various fusible metals can be inexpensively and easily formed in various shapes, the scope of the invention is considered to include the installation of a previously-formed fusible barrier of an appropriate shape at a convenient location between the donor and receptor explosives 27 and 35 in a typical well tool such as the perforator 11. Routine testing procedures will be needed, of course, to establish the critical parameters of a given fusible detonation barrier that may be advantageously employed for reliably confining various detonators. The most-important function of the barrier 45 is, of course, to reliably disarm the perforator 11 so that the receptor charge 35 will not be set off should the donor explosive charge 27 be inadvertently or prematurely detonated for any reason. Thus, it is essential that the barrier 45 be formed of a fusible material which will reliably remain in a solid state until the perforator 11 has been safely positioned at a desired depth location in a well bore as at 14. To successfully practice the invention, it is equally important that the barrier member 45 will reliably respond to a predictable event for arming the perforator 11.

Nevertheless, in distinct contrast to the new and improved methods and apparatus disclosed in the aforementioned copending application, Ser. No. 550,862, directed to the utilization of barriers having melting points lower than the temperature of the well bore fluids at the depth interval where a wireline tool is to be operated, in practicing the methods and apparatus of the present invention it is instead preferred to utilize fusible materials which have melting points than are greater than the anticipated well bore temperatures. There are a variety of eutectic and non-eutectic fusible metal alloys that can be utilized in the practice of the present invention which are the various binary, ternary, quaternary and quinary mixtures of bismuth, lead, tin, cadmium and indium or other metals. When these fusible metals are eutectic alloys, the mixture has the unusual property of having a melting point lower than the lowest melting point for any of its constituents. This intrinsic melting point is a constant physical property for any given fusible alloy and, therefore, the melting point is a precisely known temperature. Another feature of any eutectic alloy is that its melting point is also its freezing point so that there is no freezing range between the liquid state and the solid state of the alloy. In other words, a solid body of any eutectic alloy is immediately converted to a liquid once that body reaches its intrinsic melting point. The fluidity of these liquid eutectic alloys is similar to the fluidity of liquid mercury at room temperature.

There are a variety of eutectic fusible alloys of bismuth with melting points that range all the way from 117° F. to 477° F. (46.8° C. to 247° C.) As a practical matter, therefore, there is a group of seven eutectic alloys with melting points between 117° F. and 255° F. (46.8° C. to 124° C.) that are considered to be the most useful fusible metals for practicing the present invention. Although standard handbooks of metallurgy will give the precise compositions for these seven bismuth alloys that will ideally serve for providing detonation barriers in the present invention, the eutectic alloy which is best suited for operation in most wells is the eutectic alloy which has the highest melting point of 255° F. is composed of 55.5% bismuth and 44.5% lead. The other five bismuth eutectic alloys in the group are each composed of varying amounts of the above-named alloys respectively having melting points falling between the above-stated upper and lower temperature limits. In any case, in the practice of the present invention, at least one of these seven alloys will be effective for providing a reliable and predictable detonation barrier as at 45.

Those skilled in the art will, of course, appreciate that there are also non-eutectic fusible alloys which may be employed in the practice of the invention. Instead of having precise melting points and an immediate change from the solid state to the liquid state, the non-eutectic alloys have a moderate range of melting points and their intermediate state is similar to slush as the alloy is heated from the lower limit of its melting range to the upper limit of that range. For instance, one common non-eutectic fusible metal alloy is composed of 50.5% bismuth, 27.8% lead, 12.4% tin and 9.3% cadmium which has an intrinsic melting range of 158° F. to 163° F. (i.e., 70.5° C. to 72.5° C.). With other non-eutectic alloys in the same family, decreases in the percentage of bismuth to 35.1% and corresponding increases of the percentage of lead to 36.4% will result in a group of fusible metals with a range of melting points between the lower limit of 158° F. and progressively-higher upper limits up to 214° F. (111° C.). These non-eutectic alloys having a range of 158° F. to 214° F. can probably be utilized in many well bore operations to provide a reliable and predictable detonation barrier such as at 45. A second low-temperature non-eutectic alloy which would probably not be utilized is composed of 42.9% bismuth, 21.7% lead, 7.97% tin, 18.33 indium and 4.00% mercury. This latter non-eutectic alloy has a range of melting points between 100° F. to 110° F. (37.8° C. to 43.3° C.). As will subsequently become apparent, the melting range of this latter non-eutectic alloy is so low that it would not be advisable to use this particular fusible alloy in most wells.

It should be recognized that the well bore fluids in a great number of wells are at relatively-low temperatures so that a wax or other meltable fusible material with a fairly-high melting point can also be effectively employed in the practice of the present invention. Typical commerically-available waxes which could be employed would include a wax that is marketed as Halowax 1014 by Koppers, Inc. This particular wax has a melting point of 268° F. which is an ideal temperature for employing the detonating system 10 in the majority of wells in the world. Other waxes which can also be utilized include a "278 V" wax that is marketed by Kindt Collins (melting point of 275° F.) and pentaerythritol hexastearate (melting point of 275° F.).

Hereagain, it must be realized that the paramount purpose of the invention is to provide detonation barriers having reliable and predictable enabling features as well as disabling features. Thus, there could well be various situations where the well bore temperature are so hot that fusible alloys or waxes with lower melting points probably should not be utilized in practicing the invention in the interest of providing a reliable and predictable detonation barrier as at 45. The important thing to remember is that the melting point of a given fusible metal is an intrinsic physical property whether that metal is a eutectic alloy having a single melting point of a known value or is a non-eutectic alloy which has a defined range of melting temperatures. In either case, it is the established intrinsic melting temperature of the fusible alloy which provides the reliability and predictability for the barrier means 45 of the invention to prevent inadvertent detonation of the booster charge 35.

Accordingly, in keeping with the objects of the present invention, electrical heating means such as an encapsulated electrical heating element or a typical cartridge heater 46 is mounted on the cylindrical support member 40 and cooperatively arranged to serve as a aource of selectively-controlled heat for raising the body temperature of the support member. In the new and improved detonating system 10 of the invention, the heater 46 is preferably press-fitted within the elongated hole 42 in the cylindrical support member 40 to provide a suitable path for efficiently conducting heat through the metal support member and into the barrier 45. It will, of course, be appreciated that the heater 46 is preferably arranged to melt the fusible barrier in a relatively-short length of time (preferably within one or two minutes) to minimize the possibility that the donor charge 27 might be deteriorated by prolonged exposure to excessive levels of heat that will be conducted from the heater into the support member 40.

Ordinarily it is of no consequence that the perforator 11 is armed at some depth in a well bore since the perforator will typically be fired once it has been properly positioned in the well bore. Nevertheless, those skilled in the art will recognize that, at times, a perforating gun must be returned to the surface without firing the shaped charges carried by the gun. Moreover, it is not too uncommon for a well perforator to be returned to the surface without realizing that some unnoticed or unknown malfunction had prevented the explosives from being detonated as planned. In either situation, it is always considered risky to return an armed perforating gun to the surface with an unexpended detonator; and there is a distinct risk that the detonator may be inadvertently detonated after the tool has been removed from the well bore.

Those skilled in the art will appreciate the importance of the reliability and predictability of the respective arming and disarming functions of the barrier 45. On the one hand, it must be recognized that because of the unique intrinsic nature of the metal used to form the barrier 45, it can be accurately predicted that the perforator 11 will be safely diarmed until the heater 46 has been operated for a reasonable period of time for melting the barrier. On the other hand, it will also be appreciated that it is of major importance to also be assured that the perforator 11 will remain armed and ready for its intended operation only so long as the perforator is stationed at a selected depth interval. As a third aspect of the reliability and predictability of the detonating system 10, it will be realized, therefore, that so long as the barrier 45 has not been melted, since the barrier is arranged to have a melting point higher than the anticipated well bore temperatures, the barrier will reliably function to maintain the perforator 11 in its normal disarmed state should it become necessary to recover it without having carried out its intended operation. Hereagain, the value of the various features of the present invention can not be underestimated.

Even if the well temperatures are not known in advance, the service crew can safely install the detonating system 10 since the temperature ratings of the barrier 45 will ordinarily be sufficiently greater than the actual temperatures in the well bore. It will be appreciated that since the donor charge 27 is always reliably blocked by the explosion-resistant barrier 45, the perforating gun 11 is completely safeguarded whether or not the detonating system 10 is installed in the perforator. As pointed out above, even should there be a spurious electrical signal that prematurely sets off the donor charge 27, the barrier 45 will reliably prevent the receptor charge 35 from being set off whether the self-contained enclosure 25 is outside of the carrier 19 or the detonating system 10 has been installed in the perforator 11 and the perforator is still at the surface.

Figure 3:
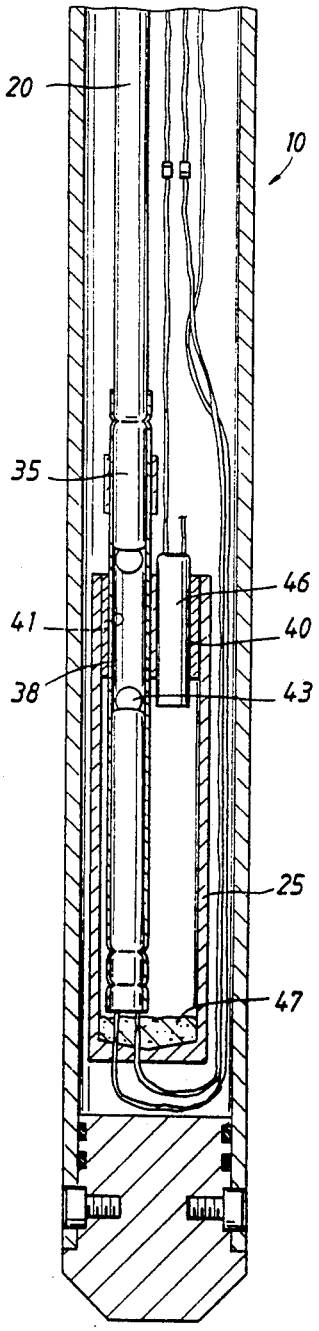
FIG. 3 is a elevational view similar to FIG. 2 depicting the detonating system of the present invention after it has been selectively armed for subsequent initiation from the surface.

Turning now to FIG. 3, the detonating system 10 of the invention is depicted to show how the detonation barrier 45 and the electrical heater 46 are utilized for reliably arming the perforator 11 once it has been lowered into a well bore. The detonating system 10 is depicted as it will appear after the heater has been operated for a sufficient length of time to melt the fusible material forming the barrier 45. As illustrated, the heater 46 has been previously operated for quickly heating the fusible barrier 45 to its melting point; and, once the barrier was melted, the resulting liquefied metal was able to flow out of the lower set of ports 43 in the intermediate portion 38 of the elongated tube 28 and, as shown at 47, fall into the bottom of the explosion-resistant housing 25.

It will be recognized that once the fusible metal alloy is liquefied, the donor charge 27 will no longer be obstructed by the plug and the donor charge is then free to direct a detonating force through the intermediate portion 38 of the elongated tube 28 with a reliable certainty that the explosive force developed by the donor will be capable of initiating the receptor charge 35. Hereagain, it should be noted that the essential point is that when the fusible alloy is solidified, it is the presence of the solid barrier 45 itself that will prevent the receptor charge in the detonator 26 from being set off should the donor charge 27 be inadvertently actuated. In other words, although the donor and receptor charges 27 and 35 are closely spaced to assure the detonation of the receptor charge, it is the solid barrier 45 that will reliably attenuate the explosive forces that will be produced by inadvertent detonation of the donor. Once, however, the barrier member 45 has melted and the liquefied metal has been drained out of the intermediate portion 38 of the tube 28, the perforator 11 is then reliably armed; and the detonator 26 is readied to be selectively actuated from the surface by whatever means are to be used for setting off the electrically-initiated donor charge 27 and, in turn, detonating the receptor charge 35 to selectively fire the perforator 11. As previously discussed, the particular manner in which the new and improved detonating system 10 is to be actuated from the surface is unrelated to the practice of the present invention.

Figure 4:
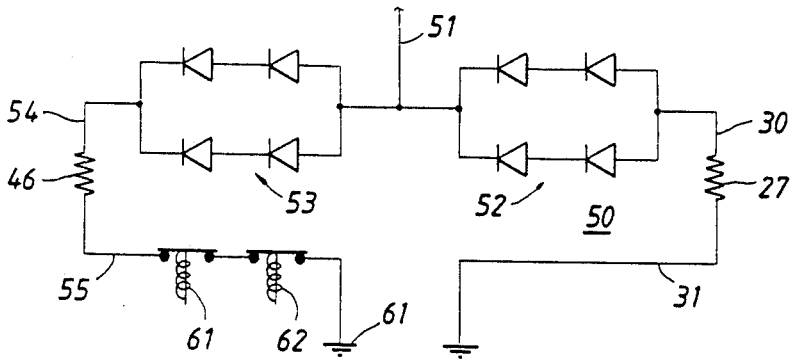
FIG. 4 is a schematic diagram of a preferred embodiment of electrical circuitry to operate the new and improved detonation system to practice the methods of the present invention.

Turning now to FIG. 4, a control system 50 which can be effectively utilized to selectively operate the new and improved detonating system 10 is depicted. Those skilled in the art will, of course, recognize that the control system 50 is, for the large part, a conventional circuit arrangement which can be installed at any convenient location inside of the carrier 19 where the control system can be effectively connected to the electrical conductors in the suspension cable 12, with the central conductor of the cable being connected to a conductor 51 in the control system. As is customary in the oilfield service industry, the detonating system 10 is selectively controlled by operating a switch for controlling a DC power source at the surface (neither of which are illustrated in FIG. 4) for supplying DC current to first and second sets of one or more reversely-oriented diodes 52 and 53 which are respectively arranged to selectively energize the detonator 26 and the heater 46. The illustrated control system 50 will, of course, function in a typical fashion to supply negative polarity DC current by way of the conductor 51 and the diodes 52 to the detonator conductor 30 for detonating the donor charge 27. Conversely, the other set of diodes 53 allow the heater to be energized by operating the surface DC power supply for connecting the positive output terminal of the power supply to the central conductor of the suspension cable and thereby supplying electrical current through the diodes 53 to the heater conductor 54 whenever the barrier 45 is to be selectively melted.

Figure 5:
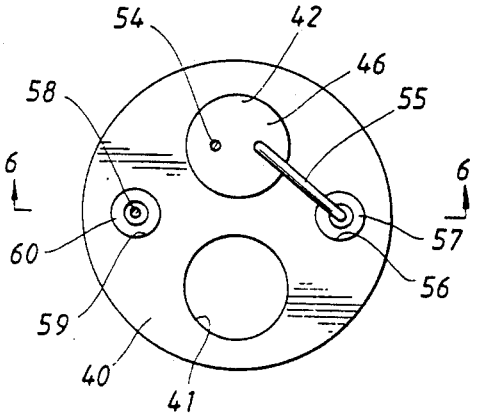
FIG. 5 is an enlarged plan view showing a preferred arrangement of the detonator support employed in the new and improved detonating system of the invention and depicting a preferred arrangement of various ones of the electrical conductors for the detonating system.

Turning now to FIG. 5, as another aspect of the present invention, an enlarged plan view is shown of the upper surface of the cylindrical detonator support member 40 as it may be arranged for positioning the detonator 26 and the heater 46. As depicted, the intermediate tubular member 38 of the detonator 26 is shown as being operatively positioned for placing the still-solidified barrier 45 within what might be properly characterized as heating proximity of the heater 46 to insure that the electrical heater will be capable of quickly heating the fusible material which is used to form the barrier in a reasonably short length of time.

Figure 6A:
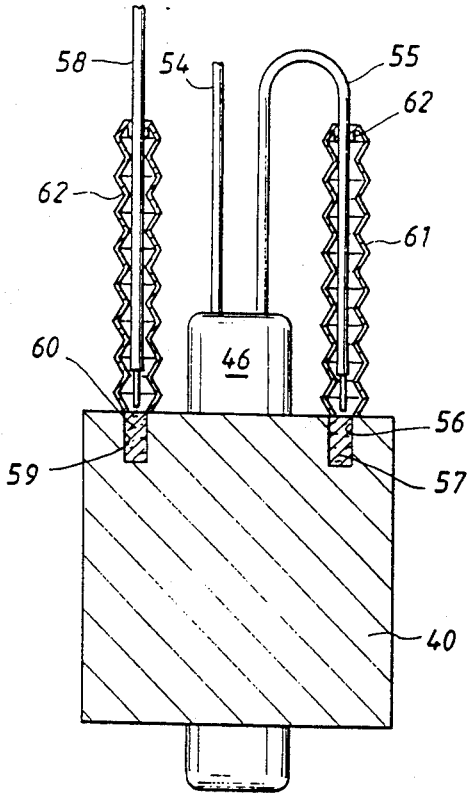
FIG. 6A is a enlarged cross-sectioned elevational view of the detonator support showing the respective positions of the electrical conductors on the support member once the detonating system of the invention has been selectively armed.
Figure 6B:
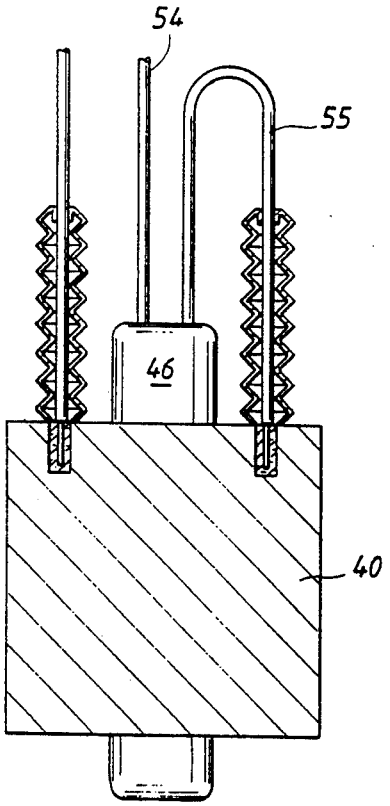
FIG. 6B is otherwise identical to FIG. 6A but shows the positions of the electrical conductors before the detonating system of the present invention has been selectively armed.

Turning now to FIG. 6A, it will be seen from the cross-sectioned elevational view of the support member 40 that one of the heater leads 54 is encapsulated within the base of the heater 46 and that the other heater lead 55 is connected to the metal support member. In the preferred manner of accomplishing this latter connection, the bared end of the conductor 55 is mounted within a blind bore 56 in the top surface of the support member 40 and secured therein by a small quantity of an electrically-conductive fusible metal alloy 57 disposed in the blind bore. The alloy plug 57 need only have a melting point that is greater than the anticipated well bore temperature and is no more than about the melting point of the barrier 45. In a similar fashion, the bared end of a second conductor 58 is secured within a blind bore 59 in the upper surface of the support member 40 and also secured therein by a plug 60 of an electrically-conductive metal alloy which is at least comparable to the other alloy plug 57. The other end (not illustrated in FIG. 6A) of this conductor 58 is secured to a convenient ground connection as schematically illustrated at 61 in FIG. 4.

It will, of course, be recognized that as current is flowing through the two conductors 55 and 58 for energizing the heater 46 the output of the heater will be sufficient to melt the alloy plugs 57 and 60 at about the same time that the barrier 45 is melted. Thus, to reliably disconnect the conductor 55 from the support block 40, a small-diameter convoluted elastomer tube 61 is cooperatively arranged around the conductor 55 and secured to an intermediate portion thereof as by adhesive or a tight-fitting collar 62. In installing the elastomer boot 61 over the wire 55, the boot is moderately compressed and its free end is then urged against the support block with sufficient force so that once the fusible plug 57 has hardened, the boot will impose an upward biasing force on the conductor. Thus, when the fusible plug 57 is subsequently melted, the biasing force of the boot 61 will be effective to elevate the bare end of the conductor 55 completely out of the blind bore 56. Once this occurs, the initially-compressed boot 61 will be expanded a sufficient distance to completely cover the bare end of the conductor 55 to prevent the bare end from thereafter touching any part of the support block 40 or other adjacent metal surfaces. The other conductor 58 is similarly equipped with an elastomer boot 62 which will likewise lift the bare end of the conductor 58 out of its associated blind bore 59 when the fusible metal plug 60 is melted. Either one or both of these disconnections will be sufficient to permanently disconnect the heater 46 to be certain that the heating of the support block 40 is quickly discontinued. As schematically illustrated in FIG. 4, these connections of the wire ends serve as thermal switches for disconnecting the heater 46.

It will be recognized by those skilled in the art that the disconnection of the bared ends of either of the conductors 55 and 58 will provide a distinctive "kick" or visible indication on the surface equipment in the same manner as the indication caused by firing of an electrical detonator as at 26. Thus, a skilled operator will be assured that the heater 46 has been energized when this distinctive kick is viewed while the positive output of a DC power supply is coupled to the conductor 51. Upon viewing a kick of this nature, it is necessary only to switch the surface power supply for connecting the negative output of the DC power supply to the conductor 51. Hereagain, a distinctive "kick" on the current meter will provide a so-called "shot indication" that will show that the detonator 26 was successfully fired.

The lack of a distinctive "kick" showing that the heater 46 has functioned properly will, of course, be a definite indication of some malfunction in the conductors in the suspension cable 12, in the heater 46 itself, or a failure of a component or conductor in the electrical system 50. In any event, the prudent thing to do is to simply return the perforator 11 to the surface in order to find the cause of failure. Hereagain, it will be appreciated that by virtue of choosing a relatively-high melting point for the barrier 45, the operator will be assured that the barrier is still intact so that the donor charge 27 will be completely isolated and that the perforator 11 can be safely removed from the well and the detonation system 10 removed therefrom.

When the armed perforating gun 11 is being returned to the surface with the detonator 26 still unexpended, the progressive reductions in ambient well bore temperatures will not affect the detonating-blocking function of the barrier 45. Hereagain, it will be recalled that the only criteria is that the melting point of the fusible material in the barrier 45 is greater than the anticipated well bore temperatures. Accordingly, should there be spurious electrical signal which inadvertently detonates the detonator 26 while the unexpended perforator 11 is in the well bore or is at the surface, the still-solid barrier plug 45 will reliably prevent the booster charge 35 from being set off whether the perforator 11 is at the surface or is in the well bore. In any event, once the detonating system 10 with a high-temperature barrier 45 is installed in the perforator 11, it will be reliably disabled so long as the heater 46 has not been energized.

Accordingly, it will be seen that the present invention has provided new and improved methods and apparatus for selectively initiating various perforators from the surface. In particular, the present invention represents a new and improved explosive detonating system that prevents the explosive devices coupled thereto from being set off by extraneous electromagnetic signals or by spurious electrical energy while they are at the surface. Moreover, the invention provides new and improved methods for safeguarding explosive devices from inadvertent detonation and for selectively initiating these explosive devices only after they have reached a safe position by rendering the explosives inoperable until those perforators have been exposed to elevated well bore temperatures for a finite time period. The present methods and apparatus of the invention will also render these perforators inoperable should they be returned thereafter to the surface without having been operated properly.

While only particular embodiments of the present invention and modes of practicing the invention have been described above and illustrated in the drawings, it is apparent that changes and modifications may be made without departing from the invention in its broader aspects; and, therefore, the aim in the claims which are appended hereto is to cover those changes and modifications which fall within the true spirit and scope of the invention.

What is claimed is:

1. A well tool to be suspended in a well bore and comprising:

a body;

an explosive device on said body;

first means on said body for detonating said explosive device including a receptor explosive, and an electrically-initiated donor explosive selectively operable for producing an explosive force of sufficient magnitude to set off said receptor explosive;

explosion-proof housing means arranged on said body enclosing said donor explosive for confining its said explosive force;

an explosion-proof barrier of a fusible material shielding said receptor explosive so long as the temperature of said barrier stays below the melting point of said fusible material; and second means on said body operable for melting said barrier to arm said explosive device to be selectively fired in a well bore in response to the detonation of said donor explosive by an electrical signal.

2. The wall tool of claim 1 wherein said fusible material is selected from the group consisting of waxes having a melting point greater than about 200 degrees F.

3. The well tool of claim 1 wherein said fusible material is selected from the group consisting of binary, ternary, quaternary and quinary eutectic and non-eutectic mixtures of bismuth, lead, tin, cadmium and indium.

4. The well tool of claim 3 wherein said fusible material has a melting temperature greater than about 200 degrees F.

5. Well bore apparatus comprising:

an electrically-initiated donor explosive operable for detonating a receptor explosive in response to the explosive forces produced upon detonation of said donor explosive;

a barrier formed of a fusible material positioned adjacent to said donor explosive for normally blocking the transmission of said explosive forces from said donor explosive until said barrier is melted in response to heating of said barrier above the melting point of said fusible material; and arming including electrical heating means adjacent to said barrier and operable for melting said barrier to selectively remove said barrier and enabling the transmission of said explosive forces of said donor explosive to other explosives detonating proximity of said donor explosive.

6. The apparatus of claim 5 wherein said fusible material is a fusible metal alloy selected from the group consisting of binary, ternary, quaternary and quinary eutectic and non-eutectic mixtures of bismuth, lead, tin, cadmium and indium having melting points greater than the anticipated temperatures of the well bore fluids at a selected well bore depth location.

7. The apparatus of claim 5 wherein said fusible material is a wax selected from the group of waxes consisting of waxes having a melting point greater than the anticipated temperatures of the well bore fluids at a selected well bore depth location.

8. Well bore apparatus comprising:

an electrically-initiated donor explosive operable for detonating a receptor explosive in response to the explosive forces produced upon detonation of said donor explosive;

an explosion-proof housing enclosing said donor explosive for suppressing its said explosive forces, said housing including an opening for transmitting said explosive forces to the exterior of said housing, and a barrier formed of a fusible material for normally blocking said opening until said fusible material is melted in response to being heated to a temperature greater than the melting point of said fusible material; and arming means on said housing adjacent to said opening and including an electrically-operated heater selectively operable for heating said barrier to its said melting point for removing said barrier from its blocking position.

9. The apparatus of claim 8 including a receptor explosive mounted on said housing outside of said opening in detonating proximity of said donor explosive and operable only upon removal of said barrier from its said blocking position.

10. The apparatus of claim 8 wherein said fusible material is a fusible material having a melting point greater than the expected temperature of well bore fluids at a selected well bore location.

11. The apparatus of claim 10 wherein said fusible material is a fusible metal alloy selected from the group consisting of binary, ternary, quaternary and quinary eutectic and non-eutectic mixtures of bismuth, lead, tin, cadmium and indium; and said alloy has a melting point more than the anticipated temperatures of well bore fluids at a selected well bore depth location.

12. The apparatus of claim 10 wherein said fusible material is a wax selected from the group of waxes having a melting point greater than the anticipated temperatures of well bore fluids at a selected well bore depth location.

13. A perforating gun to be suspended in a well bore containing well bore fluids at elevated temperatures and comprising:

a hollow carrier;

at least one shaped charge in said hollow carrier;

means in said carrier for selectively detonating said shaped charge and including an encapsulated booster explosive, and an electrically-initiated encapsulated detonator explosive spatially disposed from said booster explosive and cooperatively arranged for detonating said booster explosive in response to explosive forces produced by firing of said detonator explosive within detonating proximity of said booster explosive;

an explosion-resistant enclosure having an access opening enclosing said detonator explosive and cooperatively arranged for positioning said access opening between said encapsulated explosives;

a normally-solid meltable barrier blocking said access opening until said barrier is heated to its melting point; and electrical heating means adjacent to said access opening and operable for selectively heating said barrier to its said melting point for unblocking said access opening and bringing said booster explosive into detonating proximity of said detonator explosive.

14. The perforating gun of claim 13 wherein said barrier is formed of a fusible metal alloy selected from the group consisting of binary, ternary, quaternary and quinary eutectic and non-eutectic mixtures of bismuth, lead, tin, cadmium and indium.

15. Well bore apparatus to be installed in a well bore perforator carrying one or more shaped explosive charges and comprising:

an explosion-proof housing formed of a material of sufficient thickness for suppressing the explosive forces of an encapsulated electrically-initiated detonator disposed therein and having an opening in one end thereof;

an encapsulated electrically-initiated detonator in said housing adjacent to and within detonating proximity of said opening;

a closure member formed of a fusible material having a predetermined melting point greater than anticipated well bore temperatures cooperatively arranged in said opening for confining the explosive forces of said detonator entirely within said chamber so long as said closure member is not heated to its said predetermined melting point; and heating means including an electrical heater arranged on said housing and operable for heating said closure member to its said predetermined melting point.

16. The apparatus of claim 15 wherein said fusible material is a fusible metal alloy selected from the group consisting of binary, ternary, quaternary and quinary eutectic and non-eutectic mixtures of bismuth, lead, tin, cadmium and indium.

17. The apparatus of claim 15 wherein said fusible material is a wax selected from the group of waxes consisting of waxes having a melting point greater than the anticipated temperatures of the well bore fluids at a selected well bore depth location.

18. The apparatus of claim 15 wherein said heating means further include thermally-responsive means cooperatively arranged on said housing for electrically disconnecting said electrical heater after said closure member is melted.

19. A method for performing a well service operation with a well tool having an explosive device coupled to a receptor explosive and an electrically-initiated explosive detonator for selectively dentonating said receptor explosive and comprising the steps of;

mounting said detonator inside of an explosion-proof housing with an opening in one end thereof adjacent to said receptor explosive and blocking said opening with a barrier comprised of a normally-solid fusible material for suppressing the explosive forces of said detonator until said well tool is lowered into a well bore;

lowering said well tool into a well bore for conducting a well service operation at a selected depth interval containing well fluids;

applying heat to said barrier for melting said barrier to unblock said opening to expose said receptor explosive to the explosive forces of said detonator; and while said detonator and said receptor explosive are in detonating proximity of one another, selectively initiating said detonator for carrying out said well service operation.

20. The method of claim 19 further including the steps of:

after said barrier has been melted, dicontinuing the heating of said barrier.

21. A method for perforating a well bore with a perforating gun having an enclosed fluid-tight carrier carrying at least one shaped explosive charge coupled to an encapsulated explosive booster and an electrically-initiated encapsulated explosive detonator spatially disposed therefrom for selectively detonating said booster and comprising the steps of:

mounting said detonator inside of an explosion-proof housing with an opening in one end thereof adjacent to said booster and blocking said opening with a barrier comprised of a normally-solid fusible material for suppressing the explosive forces of said detonator while said perforating gun is lowered into a well bore containing well bore fluids at elevated temperatures less than the melting point of said fusible material and thereby rendering said detonator temporarily ineffective for setting off said shaped explosive booster;

positioning said perforating gun in a well bore containing well fluids at elevated temperatures less than the melting point of said fusible material so that said barrier will continue to render said detonator ineffective to set off said explosive booster when said perforating gun has been positioned at a selected depth interval in the well bore;

after said perforating gun has been positioned at a selected depth interval in the well bore, applying heat to said barrier for raising said barrier to the melting point of said fusible material for removing said barrier and rendering said detonator effective to set off said explosive booster; and selectively initiating said detonator for carrying out said perforating operation.

22. The method of claim 21 further including the step of discontinuing the heating of said barrier once said barrier has been melted and before said detonator is selectively initiated.

* * * * *